United States Patent [19]

Morrissey, Jr. et al.

[11] 4,181,231

[45] Jan. 1, 1980

[54] POLAR WYE CRANE

[75] Inventors: George F. Morrissey, Jr., Fremont; Lawrence A. Wright, Alameda, both of Calif.

[73] Assignee: Paceco Division of Fruehauf Corporation, Alameda, Calif.

[21] Appl. No.: 826,717

[22] Filed: Aug. 22, 1977

[51] Int. Cl.[2] ..... B66C 17/02

[52] U.S. Cl. ..... 212/21; 212/14; 104/137

[58] Field of Search ..... 212/10–27; 414/560, 561, 562; 104/137

[56] References Cited

U.S. PATENT DOCUMENTS

| | | | |
|---|---|---|---|
| 758,399 | 4/1904 | Wilke | 212/12 X |
| 3,459,311 | 8/1969 | Averbukh et al. | 212/10 |
| 3,575,300 | 4/1971 | Durand | 212/20 X |
| 3,722,709 | 3/1973 | Buschmann | 212/12 X |

*Primary Examiner*—Albert J. Makay

*Attorney, Agent, or Firm*—Bruce & McCoy

[57] ABSTRACT

A three point suspension crane for use on a circular track having the hoist machinery disposed on the crane at points proximate the engagement of the crane with the track.

20 Claims, 7 Drawing Figures

POLAR WYE CRANE

BACKGROUND OF THE INVENTION

1. Field of the Invention

The present invention relates to bridge cranes and more particularly to a bridge crane for mounting on a circular track.

2. Description of the Prior Art

There are many types of cranes which are used for spanning an open space to pick up a load anywhere within the space and deposit it anywhere else within the space. This is generally accomplished by a bridge which moves the crane along the length of the space for movement of the load along the space and by having a moveable trolly mounted on the crane which can move the load from side to side across the width of the space.

There is a need for a special bridge crane which can span a circular working area and withstand high vertical and lateral loading. This has occurred most recently and most importantly in the area of cylindrical housings for atomic reactor power generating plants. Operation of these plants requires a crane at the top of the cylindrical enclosure which can pick up and move heavy loads, such as part of the reactor or the fuel cells, and move them anywhere within the space of the enclosure for repair or replacement.

These cylindrical structures must meet special safety standards and must be capable of accommodating earthquake stress. In recent times considerable attention has been given to seismic phenomena in view of the number of reactors which are being planned for construction in earthquake zones, such as on the coast of California and in other Pacific ocean locations.

The traditional bridge crane when experiencing earthquake loading absorbs both lateral and vertical forces. The vertical forces are a function of the weight and geometry and section properties of the bridge crane while the lateral forces are a function of the same properties of the crane plus the geometry of its contact with the wall. Thus in straight bridge cranes, which are mounted on a circular rail at only the two opposite ends, the lateral loading perpendicular to the bridge, in the horizontal direction, tends to cause forces at each the end of the bridge which wedge the bridge into one half of the circular rail. This wedging action causes very high outward loading on the circular rail tending to oblong it. This force must be overcome to protect the structure of the reactor and its contents in the event of seismic activity.

In earthquake-active areas such as California and Taiwan, the spectrum of response curves at the circular rail elevation for the bridge crane can reach G-loading spikes in excess of ten G's vertical and in excess of twenty G's lateral all falling within a response cycle time of one-tenth second to one second.

The double girder bridge crane design conventionally used for this polar application is very weak in the lateral directions. Thus the girders must be substantially increased in size to accept the G-loading in the lateral direction. As a result the girders become very heavy to react to the lateral loads and as the girders get heavier, both the vertical and lateral loads increase which is a self-defeating progression under extreme earthquake conditions. Because the bridge crane structure applies very heavy vertical and lateral loading into the containment structure itself, the size of the crane must be kept at a minimum. Therefore one problem with the prior art approach to polar bridge cranes was the excessive weight of the crane. A lighter construction was required to achieve equal load handling capacity and span where substantial lateral loading is a primary problem. In addition, the wedging action of the bridge crane on the structure in the tracks had to be reduced. Furthermore, maintenance of the hoist machinery disposed on a traveling trolley arranged to travel across the bridge crane is quite difficult and access to that machinery needed to be improved. None of the prior art teaches a solution to these problems.

SUMMARY OF THE INVENTION

The present invention is a crane for mounting on a circular track which includes a horizontal first gantry leg having a length longer than the radius of generation of the circular track. The outboard end of this gantry leg is disposed for movement along the circular track and the inboard end of the gantry leg is disposed within the circumference of the circular track. A pair of gantry legs are provided which have their inboard ends secured to the inboard end of the first gantry leg and their outboard ends disposed for movement along the circular track. The outboard ends of the gantry legs are provided with means for engaging said circular track and permitting movement therealong. A trolley is mounted on the first gantry leg for movement therealong and means are provided for moving the trolley along the gantry. A wire rope reeving system is driven by a hoist means for raising and lowering a load suspended from the trolley. Means are provided for rotating the crane on the circular track.

In a preferred embodiment of this crane, the outboard ends of the gantry legs are disposed at approximately 120° intervals around the circular track. The hoist means is disposed at the outboard ends of the pair of gantry legs and divided in part between the two of them. In one configuration the three gantry legs form a wye configuration and in another preferred embodiment the gantry legs form a T configuration.

In a further preferred embodiment of the crane the wire rope reeving system includes fleet-through sheaves mounted on the trolley and at least one equalizing sheave mounted at the end of one of the gantry legs for equalizing the load in the wire rope reeving system. The means disposed at the outboard ends of the gantry legs permitting movement of the legs along the circular track include horizontal load rollers for preventing lateral loads on said crane from generating wedging forces.

OBJECTS OF THE INVENTION

It is therefore an object of the present invention to provide a bridge crane for a circular track which is capable of withstanding seismic loading efficiently.

It is also an important object of the present invention to provide a bridge crane for a circular track which substantially minimises wedging forces which would be created by a typical bridge crane during seismic activity.

It is another object of the present invention to provide a bridge crane for a circular track which is better able to withstand substantial lateral loading than the prior art.

It is a further object of the present invention to provide a bridge crane for a circular track which distributes the vertical and side loading into lower loads at the points of contact of the crane with the supporting structure.

It is still another object of the present invention to provide a bridge crane for a circular track which minimizes the weight of the machinery supported by the bridge crane in the center of the span by removing the machinery weight out to the ends of the crane proximate the supporting structure.

And it is yet another object of the present invention to provide a bridge crane for a circular track which provides full radial and azimuth access within the area of the circular track.

Other objects and advantages in the invention will become apparent when the description of the invention is considered in conjunction with the appended drawings.

DESCRIPTION OF THE PREFERRED EMBODIMENT

Figure 1:
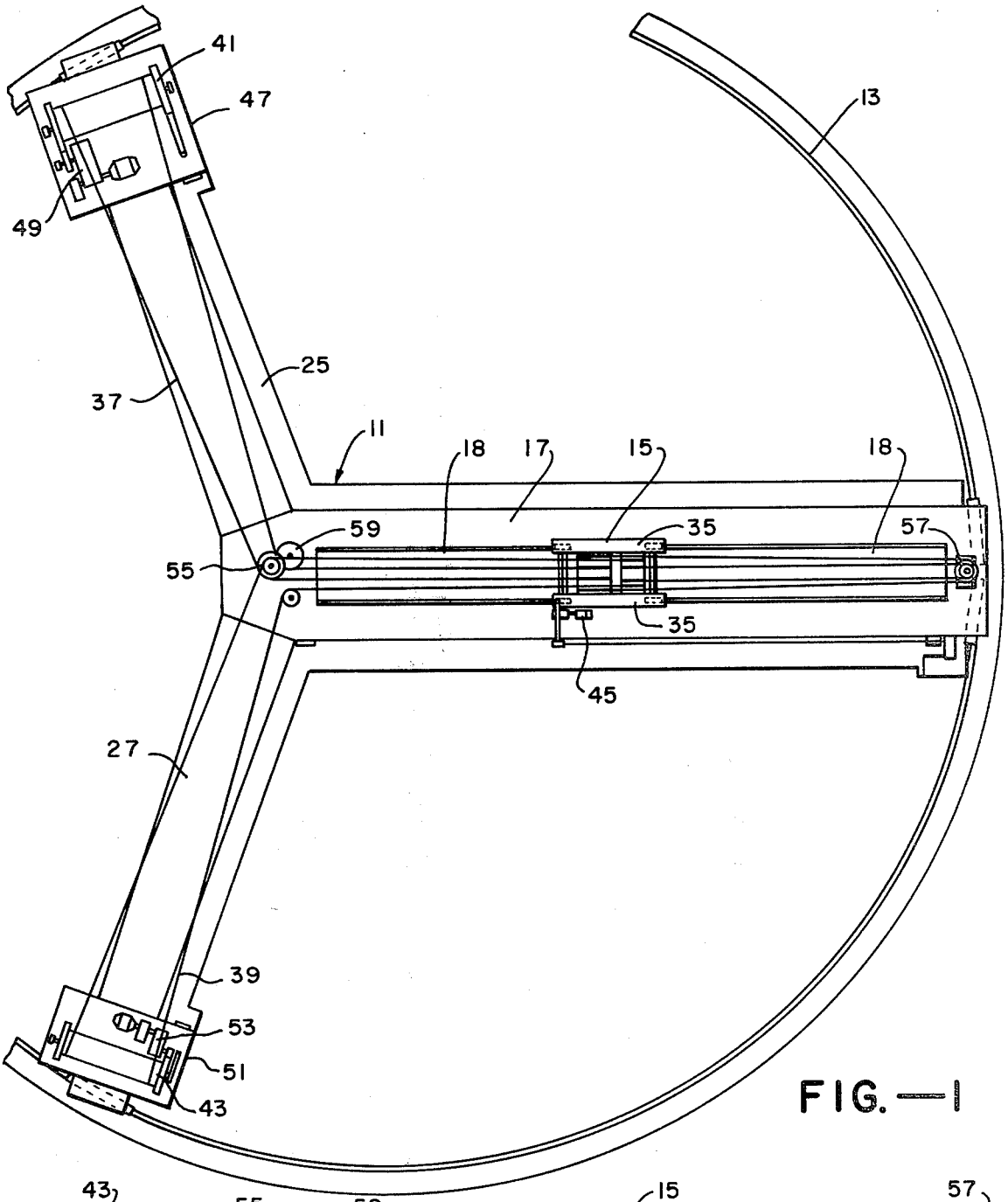
FIG. 1 is a top plan view of a preferred embodiment of the present invention wherein the configuration of the gantry is Wye-shaped.
Figure 2:
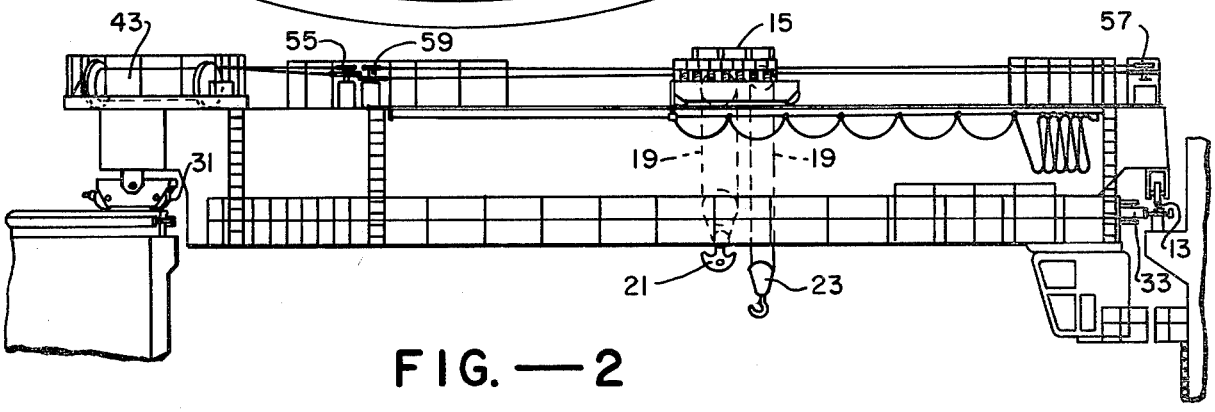
FIG. 2 is a side elevational view of the crane of FIG. 1.

The present invention is a bridge crane 11 for a flat circular track 13. The particular design is adapted for mounting on the top of a cylindrical containment structure and provides lifting capability to move loads anywhere within the structure. In order to move loads across the diameter of the structure, there is a moveable lifting trolley 15 on the bridge crane which travels at least the distance between the internal cylindrical wall and the center of generation of that wall. In addition, the crane is rotatable through 360° degrees so that the trolley can be placed at any position within the circumference of the circular track.

In the present invention, the bridge crane 11 is provided with a first horizontal gantry leg 17. This leg has a length longer than a radius of generation of the circular track 13 so that the trolley 15 can be mounted on it to move out at least to the center of generation of the circle. The outboard end of the first gantry leg is disposed for movement along the circular track. The inboard end of the gantry leg is disposed within the circumference of the circular track so as to extend out over the area within the track. In the simplest configuration, this first gantry leg should be straight and the inboard end should extend over the center of generation of the circular track.

In the preferred embodiment the first gantry leg 17 has an open central section 18 which is oriented in the vertical direction. The open central section extends along the length of the first gantry leg from a position proximate the circular track 13 to a point beyond the center of generation of the circular track along the radius thereof. The trolley 15 which moves along the first gantry leg and the open central section thereof permits load supporting reeving 19 depending from the trolley to operate through the opening, such that a load can be suspended from a hook 21 and deposited anywhere along a radius of the circular track.

A pair of horizontal gantry legs 25, 27 are provided which have their inboard ends secured to the inboard end of the first gantry leg 17. Their outboard ends are disposed for movement along the circular track 13. In its simplest form, these legs are generally straight and of equal length. They are of a simpler, lighter-weight construction than the first gantry leg because they do not have an open construction and they do not carry as much weight as does the main gantry leg. Also in the simplest form of the invention, the outboard ends of all of the three gantry legs are disposed at 120° intervals around the circular track to distribute the load as equally as possible about the supporting structure. However, it is possible to construct the device in accordance with the concept of the present invention without making the equal angular separation of the legs. This will be explained more fully hereinafter.

Figure 6:
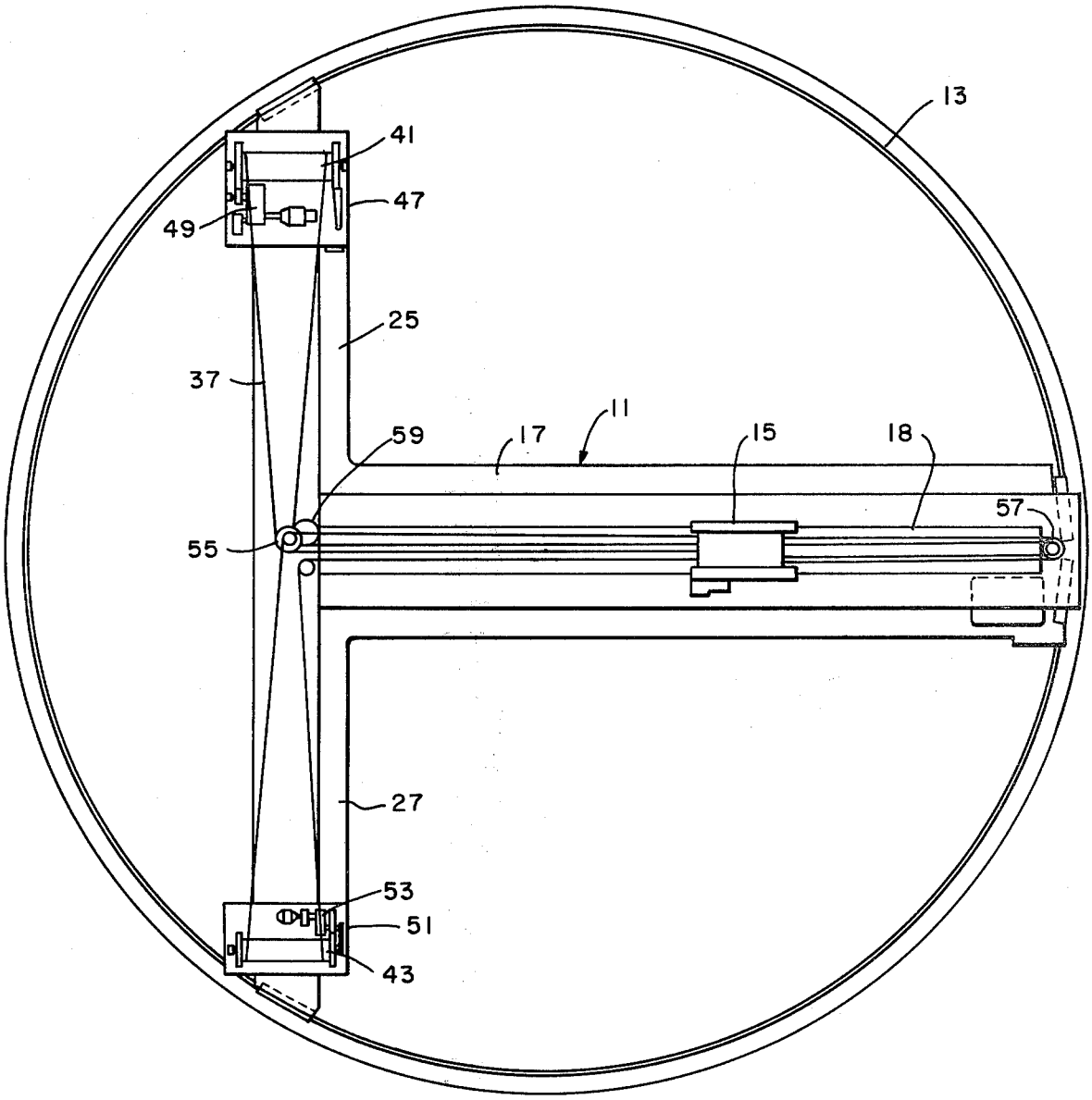
FIG. 6 is a top plan view of the T-shaped embodiment of the invention.
Figure 7:
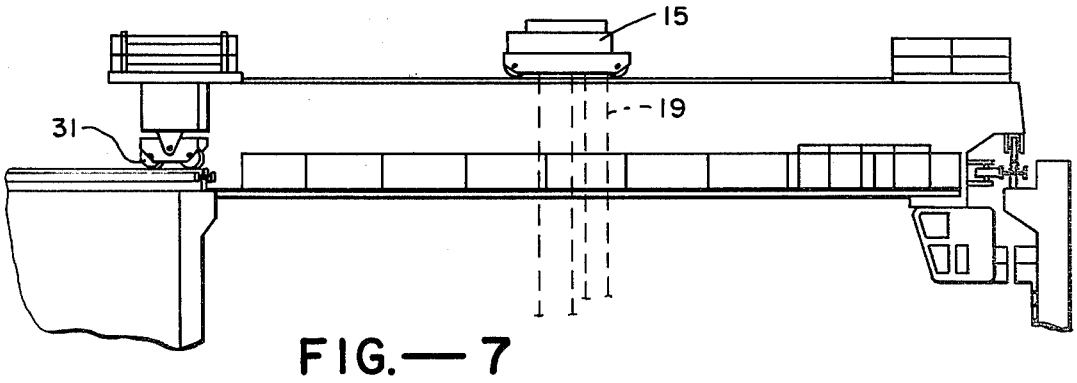
FIG. 7 is an end elevational view of the crane of FIG. 6.

In one configuration of the crane, the junction of the inboard ends of the first gantry leg 17 and the pair of equal length gantry legs 25 and 27 as shown in FIG. 1 forms a wye configuration. The advantage of this configuration is that the length of the first gantry leg can be shortened and the weight thereby reduced. However, a second configuration in the shape of a T, shown in FIG. 6 in top plan view, could be formed from the junction of the first gantry leg and the pair of equal length gantry legs. In this configuration, the pair of gantry legs could be formed as a simple unitary member but with this arrangement the main gantry leg would be longer and require a heavier construction. The length of the main gantry leg would determine the angular separation of contact with the track.

Figure 3:
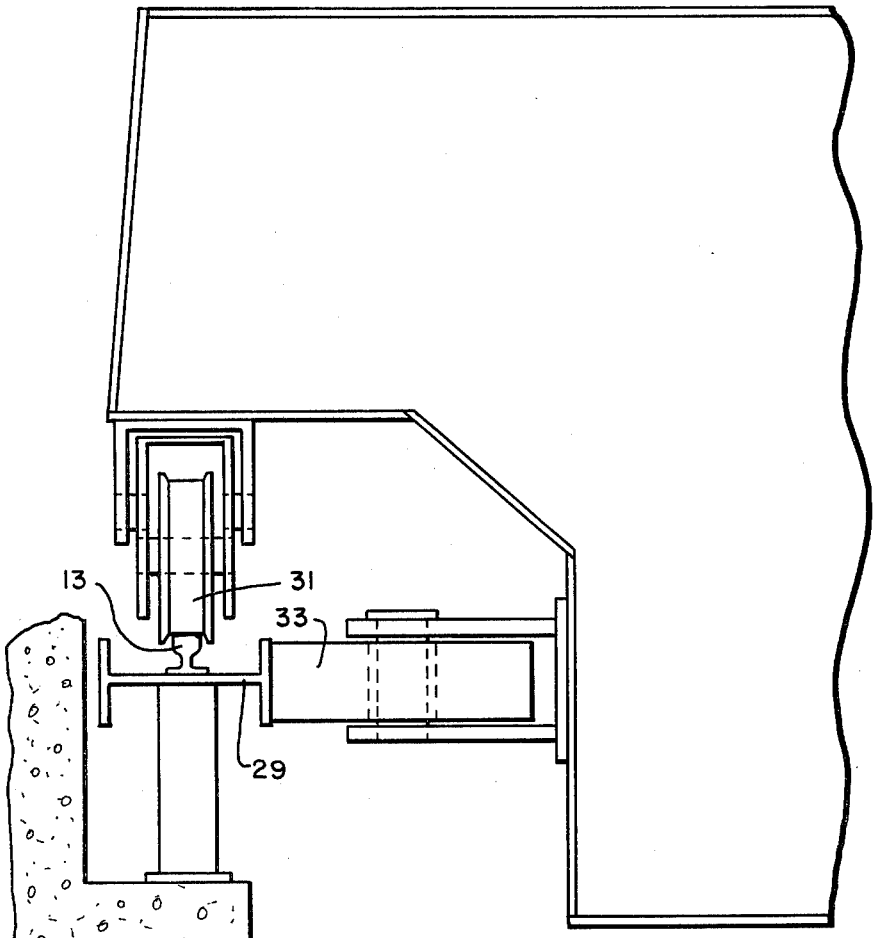
FIG. 3 is a partial side elevational view of the end of one gantry leg showing the roller engagement with the track.
Figure 4:
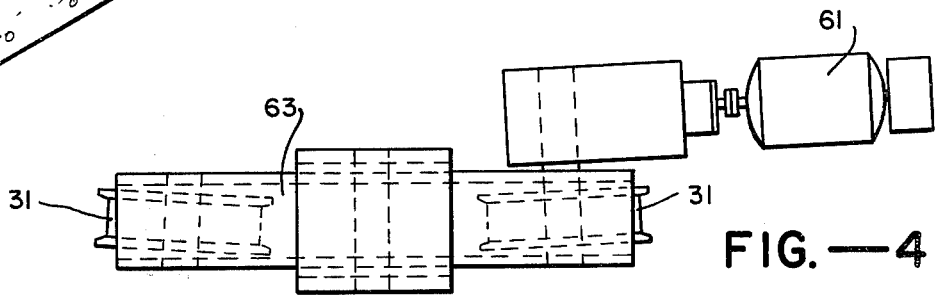
FIG. 4 is a detail top plan view of the carriage wheels and drive means disposed at the end of one gantry leg for rotating the crane.
Figure 5:
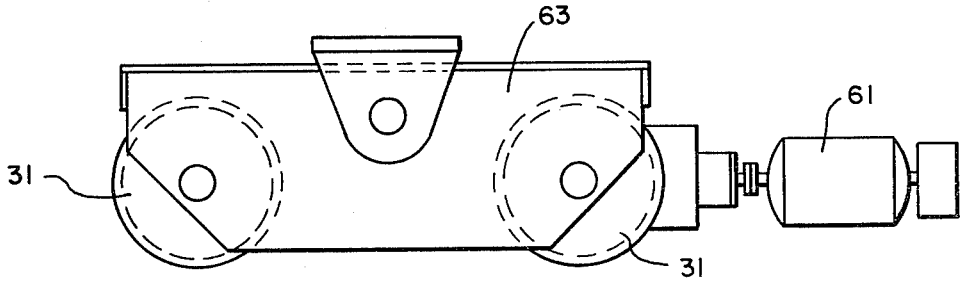
FIG. 5 is a detail side elevation of FIG. 4.

Means are disposed at the outboard ends of the gantry legs 17, 25, 27 for engaging the circular track 13 and permitting movement of the legs therealong. In the preferred embodiment, the circular track is mounted on an I beam ring 29 with standard carriage wheels 31 mounted at the end of the gantry leg in journals to ride on the circular track. This can be seen from FIGS. 3–5. In addition to the carriage wheels for supporting the vertical load of the gantry leg, horizontal load rollers 33 are provided which engage the vertical flanges of the I beam ring 29 to prevent horizontal lateral loading from wedging the gantry leg against the ring. In a straight design bridge crane on a circular track, horizontal loadings could cause wedging forces which would tend to jam the crane into one or the other halves of the circle. Because of the horizontal load rollers on the gantry legs of the present crane, lateral loading in the crane would tend to cause the gantry leg to rotate on the circular track except for loading straight down the leg. The horizontal load rollers are also utilized to guide the rotary motion of the crane.

A trolley 15 is mounted on the first gantry leg 17 for movement therealong. This is usually accomplished by means of parallel rails 35 disposed along the edges of the first gantry leg. In the usual bridge crane, the hoist machinery for lifting the load, including the hoist motors and wire rope drums, is mounted directly on this trolley. This usually imposes a heavy load on the trolley and as a result, the typical bridge crane must be designed to carry the weight of the hoist machinery as well as the weight of the load suspended from the trolley on the load hook. This design can also be used in the present invention to save the expense of remote machinery and the power delivery system and it is also preferable for absorbing lateral loading. But the design causes excessive vertical loading where it is desirable to have the load near the walls.

In the present invention, the trolley 15 is provided with fleet-through reeving sheaves (not shown in detail) whereby wire ropes 37 and 39 are driven from wire rope drums 41 and 43, respectively, which are disposed at some position off of the trolley. These wire ropes are fed to the trolley, then around a sheave to depend down through the opening in the gantry to the load lifting hook 21. They are then directed back up to the trolley and over another sheave and then out to the end of the gantry leg 17. As a result, the trolley can be moved along the gantry beam while the load is supported beneath the trolley. This fleet-through reeving system permits the heavy hoisting machinery to be mounted at the gantry ends over the support parts whereby the vertical loading is directly into the containment structure, rather than on the gantry or trolley, while allowing free movement of the trolley and the load without affecting the overall length of the lifting ropes.

The fleet through sheaves disposed on the trolley 15 may be spring-mounted. These springs isolate the load on the hook from the vertical response of the trolley to the seismic event. They interrupt the frequency at which the load vibrates to opposite that of the event to lower the vertical loading in the bridge crane.

Means are provided for moving the trolley 15 along the gantry 17. One way in which this can be accomplished would be to provide drive motors 45 for one or more of the wheels of the trolley. An alternative method would be to provide wire ropes which are secured to the trolley and driven by motors located at the ends of the gantry. In this arrangement wire rope reeving would feed from the motor inboard to the trolley and then from the trolley to the inboard end of the gantry, around a reversing sheave and back out to the motor again. Other means such as rack and pinion gears or thread screws, could also be used to drive the trolley.

A hoist means 47 is mounted at the outboard end of at least one of said gantry legs 25 or 27. The hoist means includes a wire rope drum 41 and a motor 49 for actuating the wire rope drums. In the preferred embodiment of this invention, the hoist means has been removed from the trolley and mounted at the outboard ends of one of the equal length gantry legs. It may be preferable when more than one hoist means or drive motor is utilized to mount a portion of the hoist means on the other gantry leg, whereby the weight of the hoist means is divided in part between the pair of gantry legs. In other words, a portion of the weight is disposed on each of the legs to equalize the load on the circular track and on the track-supporting structure. In the preferred embodiment, this is easily accomplished since the lifting trolley 15 has a main lifting hoist 47 and an auxiliary lift hoist 51. The main lift hoist actuates a much heavier load hook 21 suspended from the trolley which moves at a comparatively slow rate. The auxiliary hook 23 is a faster unit and is driven by an auxiliary wire rope drum 43 and hoist motor 53 which are mounted on the other of the equal length gantry legs 27.

A wire rope reeving system is provided which is driven by a hoist means 47. The wire rope reeving system raises and lowers the load suspended from the trolley 15. The wire rope reeving system includes the wire rope, all of the sheaving through which it passes, and the load hook 21 suspended from the trolley. In the preferred embodiment, the wire rope is reeved through fleet-through sheaves which are mounted on the trolley. Fleet-through sheaves refer to the sheaves which move with the trolley as it moves along the track. At any time that the trolley moves, the wire rope fleets through the sheaves on the trolley and through the load hook, whether there is a load being lifted or held at a stationary height or no load at all.

In the preferred embodiment a wire rope reeving system is utilized. Wire rope 37 is reeved from one end of the hoist drum 41 to and around a direction changing sheave 55 at the junction of the gantry legs, along the first gantry leg 17 and over a first fleet-through sheave mounted on the trolley. The wire rope 37 then is fed from the sheave down to the load block 21, which is suspended from the trolley, back up to the trolley and either over a head block to provide a multiple part rope support for the hook or over a second fleet-through sheave and then outboard to the end of the first gantry leg where an equalizing sheave 57 is disposed. The wire rope is reeved around this equalizing sheave 57 back to the trolley over a third fleet-through equalizing sheave, down to the second half of the load block and back up over a fourth fleet-through sheave on the trolley, inboard to a direction-reversing sheave 59 and outboard to the drum 41. Thus as a load is lifted by the drum, any differences in length in the two sides of the wire rope are adjusted by shifting slack or excess rope from one side to the other around the equalizing sheave 57. A similar reeving arrangement is used for the auxiliary hook 23 which works concurrently and in the same manner as the first described portion of the reeving system. Other reeving systems can be used.

Means are provided for rotating the crane 11 on the circular track 13. This usually includes drive motors 61 located on the support trucks 63 disposed at the outboard ends of each of the gantry legs. The motors drive the carriage wheels 31 mounted on top of the circular track. It is possible of course that other drive arrangements could be utilized to rotate the crane.

Thus the present invention provides many advantages over the prior art. The arrangement of the first gantry leg permitting the trolley to travel from the circular track out to and beyond the center of generation of the track, combined with the rotatability of the crane through the full 360°, permits complete coverage of the enclosed area by the load lifting trolley.

The removal of the hoist machinery from the lifting trolley considerably reduces the dead load that is carried by the bridge. Placing those loads at the ends of the gantry legs as close to the track as possible transfers most of the load to the supporting structure. This placement also facilitates access and repair of the hoist machinery because it can be located near one of the ladders mounted on the wall for reaching the gantry elevation, and in addition, it is much more open and easy for repair when mounted on the platforms where space is less critical than it would be if all the machinery were located on the lifting trolley. A further advantage to the placement of the hoist machinery on platforms at the outboard ends of the gantrys is that the wire rope drums can be driven electrically with a minimum of interconnecting electrical circuits to the trolley, thereby eliminating the more complicated connection arrangement needed if the wire rope drums were mounted on the trolley.

Removing the hoist machinery from the trolley permits the fleet-through sheaves mounted on the trolley to be spring loaded to further reduce the design loading of the bridge structure.

One of the most important aspects of this invention is that the wye or T concept affords greater lateral girder bracing. The wye configuration is the most efficient way to transmit the lateral loading into the containment structure because regardless of which direction the lateral load is transmitted, there is no more than 120° between reaction points. In a conventional bridge crane, this approach is 180° which theoretically could mean an infinite outward loading into the containment structure.

The use of either polar wye or T configurations in conjunction with a moveable trolley which travels no farther than the length of a radius of a circular structure permits lighter weight girders. This, in turn, minimizes vertical loading into the containment structure from the crane itself and increases the capability of the structure to withstand earthquake stress.

In addition, the polar crane of this invention and the use of horizontal load rollers at points where the gantry legs of the crane engage the circular track of the containment structure overcomes the wedging action which is common to conventional bridge cranes in times of seismic activity.

It will be seen from the foregoing description of the preferred embodiment of the invention, and the advantages attributable thereto, that the objects of the invention can be readily achieved. While the invention has been described in detail, it is not to be limited to such details except as may be necessitated by the appended claims.

What we claim is:

1. A bridge crane for a circular track comprising a first horizontal gantry leg having a length longer than the radius of generation of said circular track with the outboard end of said gantry leg disposed for movement along said circular track and the inboard end of said gantry leg being disposed within the circumference of said circular track and over the center of generation of said circular track, a pair of horizontal gantry legs having their inboard ends secured to the inboard end of said first gantry leg and their outboard ends disposed for movement along said circular track, means disposed at the outboard ends of said gantry legs for engaging said circular track and permitting movement therealong, a trolley mounted on said first gantry leg for movement therealong, means for moving said trolley along said gantry, a wire rope reeving system and hoist means for raising and lowering a load suspended from said trolley, and means for rotating said crane on said circular track.

2. The crane of claim 1 wherein the outboard ends of said gantry legs are disposed at 120° intervals around said circular track.

3. The crane of claim 1 wherein the pair of horizontal gantry legs are of equal length.

4. The crane of claim 2 wherein the junction between said first gantry leg and said pair of gantry legs forms a wye configuration.

5. The crane of claim 2 wherein the junction between said first gantry leg and said pair of gantry legs forms a T configuration.

6. The crane of claim 1 wherein the hoist means is mounted at the outboard end of at least one of said gantry legs and said wire rope reeving system includes fleet-through pulleys mounted on the trolley.

7. The crane of claim 1 wherein the weight of the hoist means is divided between the pair of gantry legs.

8. The crane of claim 1 wherein the means disposed at the outboard ends of said gantry legs for engaging the circular track includes horizontal load rollers for preventing lateral loads on said crane from generating wedging forces.

9. A bridge crane for a circular track comprising a first horizontal gantry leg having a length longer than the radius of generation of said circular track with the outboard end of said gantry leg disposed for movement along said circular track, said first gantry leg having its inboard end extending over the center of generation of said circular track, a pair of equal length horizontal gantry legs having their inboard ends secured to the inboard end of said first gantry leg and their outboard ends disposed for movement along said circular track, means disposed at the outboard ends of said gantry legs for engaging said circular track and permitting movement therealong, and said means including horizontal load rollers for preventing lateral loads on said crane from generating wedging forces, a trolley mounted on said first gantry leg for movement therealong means for moving said trolley along said first gantry leg, hoist means and a wire rope reeving system driven by said hoist means for raising and lowering a load suspended beneath said trolley, and means for rotating said crane on said circular track.

10. The crane of claim 9 wherein the outboard ends of said gantry legs are disposed at 120° intervals around said circular track.

11. The crane of claim 10 wherein the junction between said first gantry leg and said pair of gantry legs forms a wye configuration.

12. The crane of claim 10 wherein the junction between said first gantry leg and said pair of gantry legs forms a T configuration.

13. The crane of claim 9 wherein the hoist means is mounted at the outboard end of at least one of said gantry legs and said wire rope reeving system includes fleet-through pulleys mounted on the trolley.

14. The crane of claim 13 wherein the hoist means includes a main wire rope hoist drum disposed at the outboard end of one of said equal length gantry legs.

15. The crane of claim 14 wherein the hoist means includes an auxilliary wire rope hoist drum disposed at the outboard end of the other of said equal length gantry legs.

16. The crane of claim 9 wherein the reeving system includes at least one equalizing sheave disposed proximate the outboard end of said first gantry leg.

17. The crane of claim 9 wherein said first gantry leg has an open central section in the vertical direction extending along its length from proximate the circular track to a point beyond the center of generation of said circular track whereby the load supporting reeving depending from said trolley operates through said opening to move and deposit a load anywhere along a radius of said circular track, said equal length gantry legs being of a lighter weight and simpler construction than said first gantry leg.

18. The crane of claim 9 wherein the fleet-through sheaves disposed on said trolley are spring mounted to reduce vertical loading.

19. A bridge crane for a circular track comprising a first straight horizontal gantry leg having a length longer than the radius of generation of said circular track with the inboard end thereof extending over the center of generation of said circular track, said first gantry leg having an open central section in the vertical direction extending along its length from proximate the circular track to a point beyond the center of generation of said circular track whereby load supporting reeving can depend and operate through said opening to pick up, move, and deposit a load anywhere along a radius of said circular track, a pair of generally straight equal length horizontal gantry legs having their inboard ends secured to the inboard end of said first gantry leg with the junction of said legs forming a wye configuration, the outboard ends of said gantry legs being disposed for movement along said circular track, at approximately 120° intervals therealong, said equal length gantry legs being of a lighter weight and simpler construction than said first gantry leg, means disposed at the outboard ends of said gantry legs for engaging said circular track and permitting movement therealong, said means including horizontal load rollers for preventing lateral loads on said crane from generating wedging forces, a trolley mounted on said first gantry leg for movement therealong with fleet-through reeving sheaves being mounted on said trolley, means for moving said trolley along the length of said first gantry leg, hoist means mounted at the outboard ends of said equal length gantry legs with the weight of said hoist means being divided in part between the pair of gantry legs, a wire rope reeving system driven by said hoist means and having at least one wire rope reeved throught the fleet-through sheaves mounted on said trolley for raising and lowering a load suspended beneath said trolley, said wire rope reeving depending through the central opening in said first gantry leg, and means for rotating said crane on said circular track.

20. A bridge crane for a circular track comprising a first straight horizontal gantry leg having a length longer than the radius of generation of said circular track with the inboard end thereof extending over the center of generation of said circular track, said first gantry leg having an open central section in the vertical direction extending along its length from proximate the circular track to a point beyond the center of generation of said circular track whereby load supporting reeving can depend and operate through said opening to pick up, move, and deposit a load anywhere along a radius of said circular track, a pair of generally straight equal length horizontal gantry legs having their inboard ends secured to the inboard end of said first gantry leg with the junction of said legs forming a T configuration, the outboard ends of said gantry legs being disposed for movement along said circular track, at approximately 120° intervals therealong, said equal length gantry legs being of a lighter weight and simpler construction than said first gantry leg, means disposed at the outboard ends of said gantry legs for engaging said circular track and permitting movement therealong, said means including horizontal load rollers for preventing lateral loads on said crane from generating wedging forces, a trolley mounted on said first gantry leg for movement therealong with fleet-through reeving sheaves being mounted on said trolley, means for moving said trolley along the length of said first gantry leg, hoist means mounted at the outboard ends of said equal length gantry legs with the weight of said hoist means being divided in part between the pair of gantry legs, a wire rope reeving system driven by said hoist means and having at least one wire rope reeved through the fleet-through sheaves mounted on said trolley for raising and lowering a load suspended beneath said trolley, said wire rope reeving depending through the central opening in said first gantry leg, and means for rotating said crane on said circular track.

* * * * *